US006277058B1

(12) United States Patent
Sparks

(10) Patent No.: US 6,277,058 B1
(45) Date of Patent: Aug. 21, 2001

(54) RESTRICTED RESISTANCE RANGE WEIGHT SELECTOR SYSTEM

(76) Inventor: Patrick L. Sparks, 3619 Stagecoach Trail, Weatherford, TX (US) 76087

( * ) Notice: Subject to any disclaimer, the term of this patent is extended or adjusted under 35 U.S.C. 154(b) by 0 days.

(21) Appl. No.: 09/386,968

(22) Filed: Aug. 31, 1999

Related U.S. Application Data

(60) Provisional application No. 60/098,731, filed on Sep. 1, 1998.

(51) Int. Cl.[7] ..... A63B 21/062

(52) U.S. Cl. ..... 482/98; 482/99; 482/100

(58) Field of Search ..... 482/93, 94, 98, 482/99, 908, 100

(56) References Cited

U.S. PATENT DOCUMENTS

| | | | | |
|---|---|---|---|---|
| 4,093,214 | | 6/1978 | Coker et al. . | |
| 4,317,566 | | 3/1982 | Uyeda et al. . | |
| 4,339,125 | | 7/1982 | Uyeda et al. . | |
| 4,610,449 | | 9/1986 | Diercks, Jr. . | |
| 4,744,559 | | 5/1988 | Mahnke et al. . | |
| 4,834,365 | * | 5/1989 | Jones | 482/100 |
| 4,911,435 | * | 3/1990 | Johns | 482/137 |
| 5,637,064 | | 6/1997 | Olson et al. . | |
| 5,769,762 | | 6/1998 | Towley, III et al. . | |

* cited by examiner

*Primary Examiner*—Mickey Yu
*Assistant Examiner*—Victor K. Hwang
(74) *Attorney, Agent, or Firm*—Daniel V. Thompson

(57) ABSTRACT

In an exercise machine having at least one cable, lift shaft and weight stack, the weight stack including a plurality of weights extending vertically from lowermost weights to uppermost weights, the weights and lift shaft having corresponding apertures to permit the selection of weights lifted by a lifting bar, a restricted range weight selector system includes a plurality of differently-sized weight selector pins and the apertures in the weights and/or lift shaft being progressively sized, such that the range of weights that may be selected by a user is restricted depending on the size of selector pin in the user's possession.

3 Claims, 3 Drawing Sheets

RESTRICTED RESISTANCE RANGE WEIGHT SELECTOR SYSTEM

This application claims the benefit of U.S. Provisional Application No. 60/098,731, filed Sep. 1, 1998.

TECHNICAL FIELD

The present invention relates to progressive resistance exercise equipment, and more particularly to a restricted resistance range safety system for progressive weight resistance training equipment.

BACKGROUND ART

The therapeutic value of progressive resistance exercises has long been recognized. Exercising muscles against progressively increasing resistance not only results in added strength and endurance in the muscles, but also in the improvement of neuromuscular coordination and in a more efficient functioning of the cardiovascular and respiratory systems.

Traditionally apparatus such as dumbbells and barbells have been used for progressive exercises. The use of such apparatus, however, can be extremely dangerous when undertaken without proper training and supervision. When a large amount of weight is being lifted, barbells are particularly dangerous and present difficult balancing problems. If they are dropped, serious injury can result to the trainee or to those about him.

In the past, various types of progressive weight training machines have been suggested to overcome the drawbacks of barbells and dumbbells. Among the most successful of these prior art devices are those that include cables and stacks of weights, such as those described in described in U.S. Pat. No. 4,093,214. In the conventional cable and weight stack system, the user selects the amount of weight to be lifted by inserting a pin in the lowermost weight of the stack to be lifted. The cable is then interconnected to the weight stack by the pin, and the lowermost weight and all weights above it are lifted when the machine is actuated.

Prior art apparatus embodying cable systems, while avoiding the drawbacks of free weights, have a drawback in that it is possible for the user to set the equipment up so that he is lifting more weight than is appropriate for that individual. This can lead to serious injury.

Thus, there presently exists a need for a safety system that permits restriction of weight selection to safe values.

BRIEF DESCRIPTION OF THE DRAWINGS

A more complete understanding of the invention and its advantages will be apparent from the Detailed Description taken in conjunction with the accompanying Drawing, in which.

DETAILED DESCRIPTION OF THE PREFERRED EMBODIMENT

Figure 1:
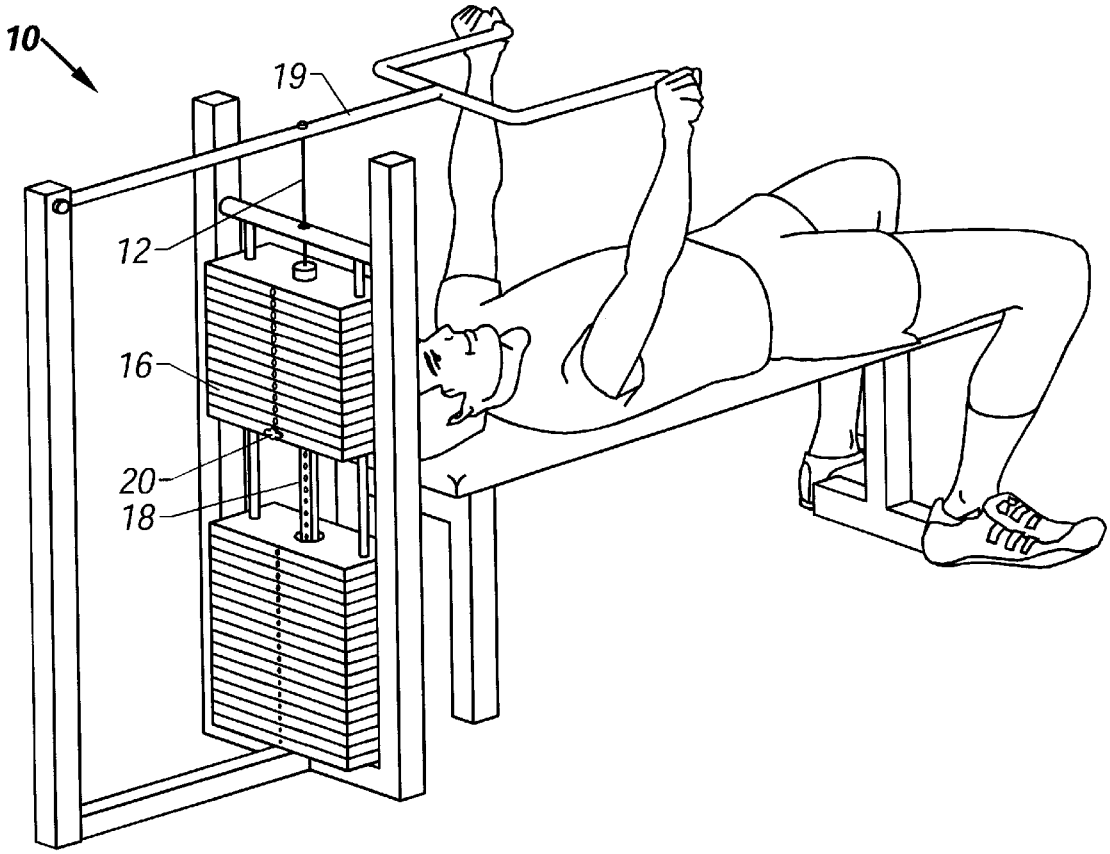
FIG. 1 is a schematic perspective view of the of the present invention.
Figure 2:
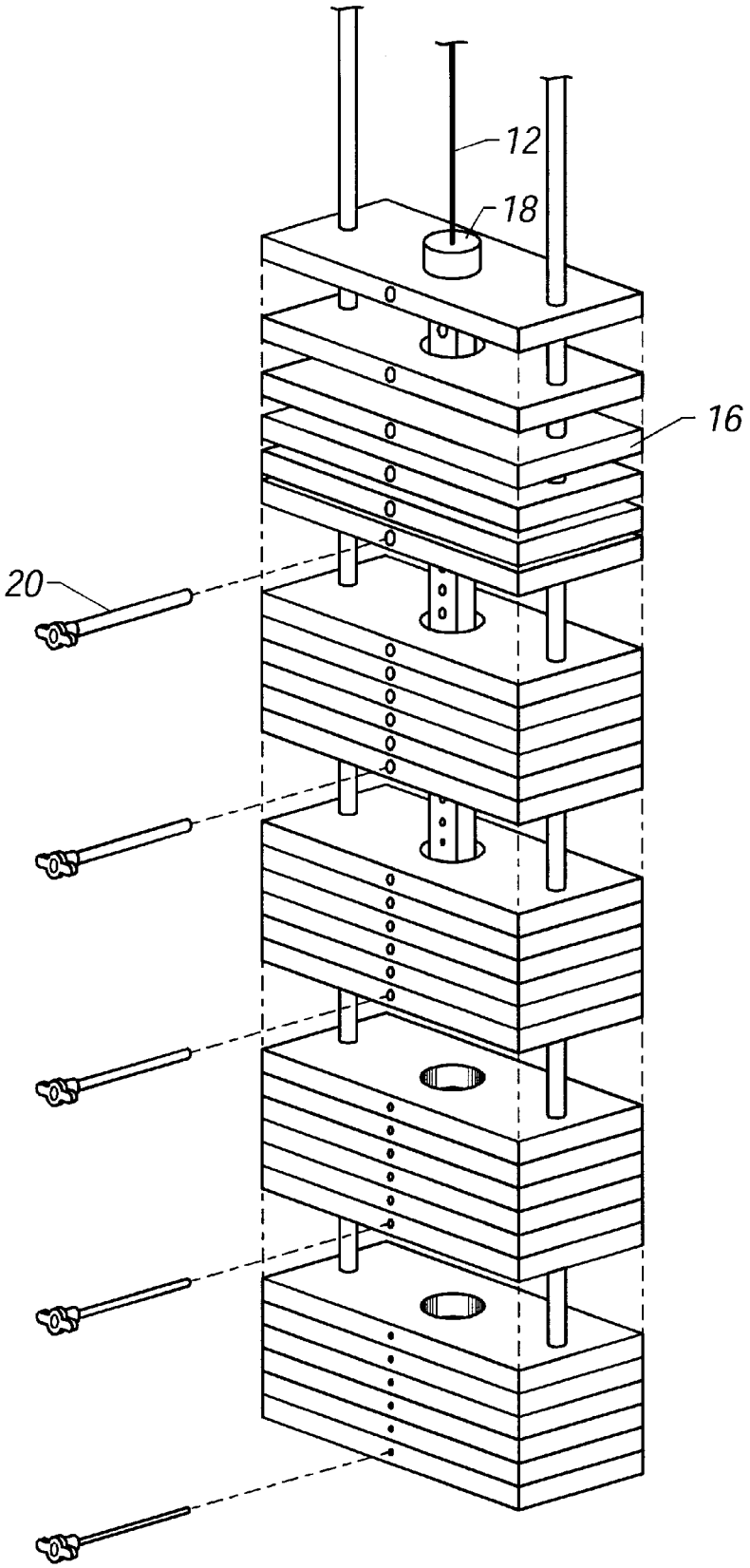
FIG. 2 is a partially exploded view of the weight stack of the present invention.
Figure 3:
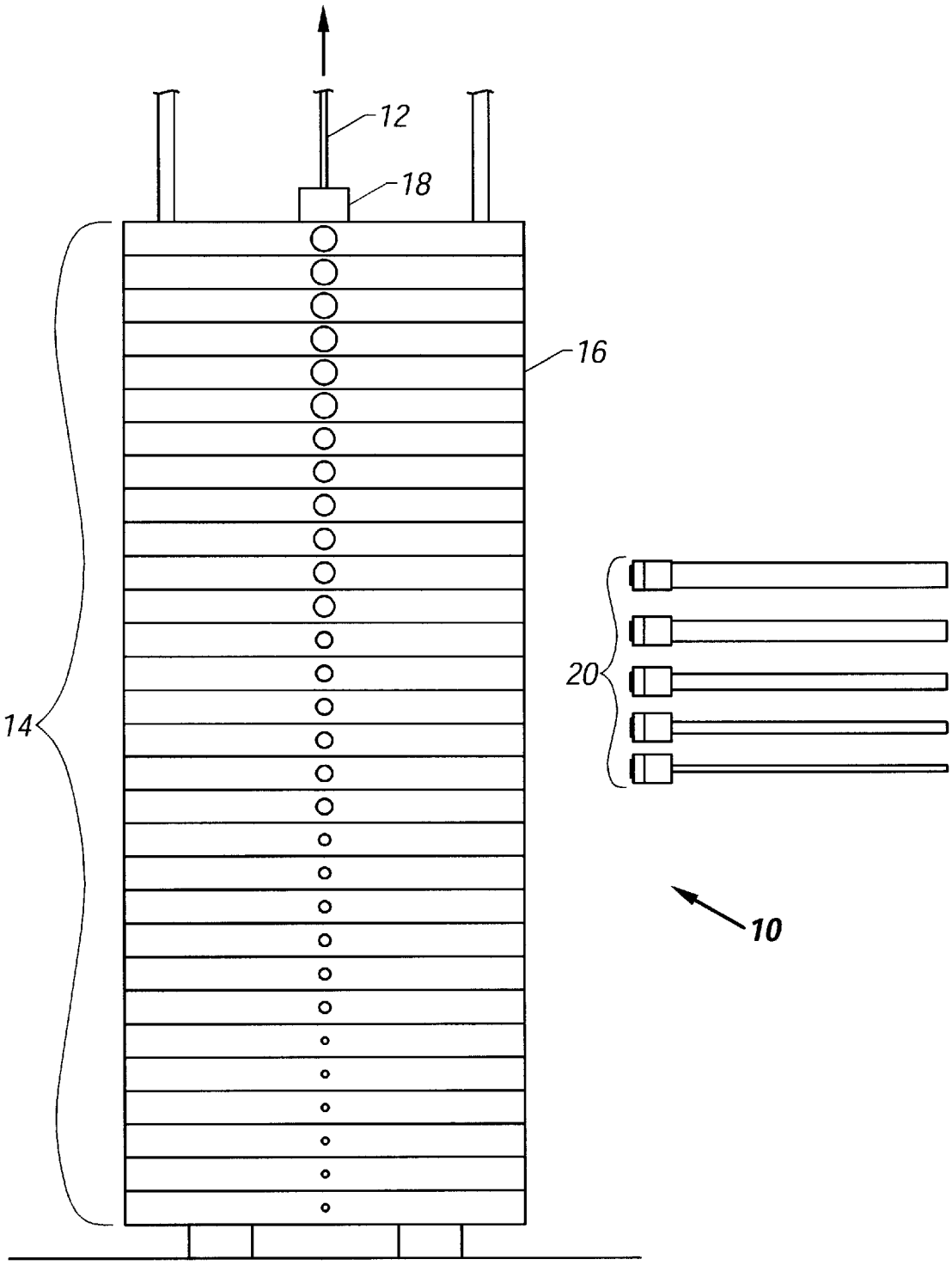
FIG. 3 is a schematic side view of the weight stack of the of the present invention.

Referring to FIGS. 1 through 3, where like numerals indicate like and corresponding elements, exercise machine 10 is illustrated in a simplified schematic form for ease of understanding. Exercise machine 10 includes a cable 12 and a weight stack 14. Weight stack 14 includes a plurality of weights 16, a lift shaft 18, a lifting bar 19, and a plurality of weight selector pins 20. Cable 12 extends to lifting bar 19 in conventional fashion, so that exercise is enabled by selecting the desired number of weights 16 in weight stack 14 and moving the lifting bar 19 up and down. FIG. 1 illustrates a thirty-plate, five-range stack, but any number of configurations can be chosen as a matter of design choice. As an example, the weight selector pins could vary from smallest to largest by the diameters 3/16 inch, 1/4 inch, 5/16 inch, 3/8 inch, 7/16 inch, and 1/2 inch. In the event a weight selector pin as small as 3/16 inch in diameter is used, careful attention must be paid to the shear strength of the material used to ensure adequate strength for the application. Colors can also be used to differentiate the sizes.

In the prior art, any number of weights 16 could be selected, leading to the potential of injury for the untrained.

In operation, the present invention in one of its forms is the provision of differently sized weight selector pins 20, with corresponding differently sized holes in weights 16, as illustrated. For example, a user needing restriction to a lighter weight stack would be issued the larger weight selector pin 20, so that only the one to six weights 16 could be selected. More experienced users could be issued smaller selector pins 20, enabling a greater selection of weight stack amounts.

The purpose of the restricted resistance range weight stack system is to incrementally limit the access of individual users such as novices (children), trainees, senior citizens, etc. to the potential resistance of the weight stack. This is advantageous because it limits the potential for the user to incorrectly select an amount of resistance that would be far beyond their individual capability and possibly lead to injury. It is also possible to utilize the system to effectively manage larger groups of users with fewer personnel. Control of an individual's progression by limiting their access to inappropriate weight/resistance may help provide a safer, more predictable and positive outcome from the exercise routine.

By deliberate sizing and sometimes grouping of those sizes of the selector holes located in the weight plates and/or lift shaft, access can be restricted by matching the diameter of the weight selector pin to those hole sizes. The larger holes will be located in the uppermost plates and as the resistance potential of the stack increases the selector holes will become progressively smaller. The individual trainees will be issued their own personal selector pin which will match their overall ability to exercise within the range of weight/resistance accessible by that selector pin. Qualified personnel must be present during the use of this system as it is intended to be is administered as part of a controlled workout routine for the largely uninitiated.

The methods used to size the holes can include:

a. specific drilling of different hole sizes in the weight stack and/or lift shaft; or b. utilizing weight plate/lift shaft hole inserts of plastic or other material which can restrict access by reducing the pre-drilled hole size. (Application of this technology to existing exercise equipment is to be strictly prohibited).

Other features may include:

a. color coding of various size inserts with selector pin handles to match;

b. color coding of the weight stack itself; and c. quick change inserts w/tool.

Whereas, the present invention has been described with respect to a specific embodiment thereof, it will be understood that various changes and modifications will be suggested to one skilled in the art, and it is intended to encompass such changes and modifications as fall within the scope of the appended claims.

What is claimed is:

1. A weight stack for an exercise machine comprising:

a single stack of a plurality of weight plates extending vertically from a lowermost weight plate to an uppermost weight plate, each weight plate between the uppermost weight plate and the lowermost weight plate in contact with a pair of adjacent weight plates;

a lift shaft having a plurality of spaced apertures, at least two of the apertures having different dimensions;

at least two selector pins, each selector pin having a dimension corresponding to one of the at least two dimensions of the apertures of the lift shaft;

each weight plate including a central bore to receive the lift shaft;

each weight plate further including an opening having a size corresponding to one of the at least two dimensions of the apertures of the lift shaft such that a correspondingly dimensioned selector pin is selectively inserted into the opening to engage with the correspondingly dimensioned aperture of the lift shaft so that all weight plates above a selected weight plate are lifted when the lift shaft is lifted; and the dimensions of the apertures and size of the openings are progressively dimensioned such that a selector pin corresponding to the opening of the uppermost weight plate and its corresponding aperture in the lift shaft is physically restricted from insertion into the opening of the lowermost weight plate and its corresponding aperture in the lift shaft, so that a user is restricted in the amount of weight resistance available dependent upon the selector pin in the user's possession.

2. The weight stack of claim 1, wherein the opening in the lowermost weight plate are sized smaller than the opening in the uppermost weight plate, so that possession of a smaller dimensioned selector pin permits a user to select a greater range of weight resistance.

3. The weight stack of claim 1, wherein the openings in the plurality of weight plates are progressively sized in a plurality of groups.

* * * * *